US009644896B2

(12) United States Patent
Nagai et al.

(10) Patent No.: US 9,644,896 B2
(45) Date of Patent: May 9, 2017

(54) FIN-AND-TUBE HEAT EXCHANGER AND REFRIGERATION CYCLE DEVICE

(71) Applicant: Panasonic Intellectual Property Management Co., Ltd., Osaka (JP)

(72) Inventors: Masaaki Nagai, Osaka (JP); Masanobu Wada, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 93 days.

(21) Appl. No.: 14/783,052

(22) PCT Filed: Apr. 9, 2014

(86) PCT No.: PCT/JP2014/002018
§ 371 (c)(1),
(2) Date: Oct. 7, 2015

(87) PCT Pub. No.: WO2014/167845
PCT Pub. Date: Oct. 16, 2014

(65) Prior Publication Data

US 2016/0054065 A1 Feb. 25, 2016

(30) Foreign Application Priority Data

Apr. 12, 2013 (JP) ..... 2013-083462

(51) Int. Cl.
*F28D 1/04* (2006.01)
*F28D 1/02* (2006.01)
(Continued)

(52) U.S. Cl.
CPC ..... *F28D 1/024* (2013.01); *F28D 1/0477* (2013.01); *F28F 1/32* (2013.01); *F28F 1/325* (2013.01); *F28F 2265/14* (2013.01)

(58) Field of Classification Search
CPC ..... F28D 1/024; F28D 1/0477; F28F 1/325; F28F 1/32; F28F 2265/14
(Continued)

(56) References Cited

U.S. PATENT DOCUMENTS 3,645,330 A * 2/1972 Albright ..... F28F 1/32 165/151
3,796,258 A * 3/1974 Malhotra ..... F28F 1/325 165/151
(Continued)

FOREIGN PATENT DOCUMENTS

JP 04-093594 3/1992
JP 11-125495 5/1999
(Continued)

OTHER PUBLICATIONS

International search report of PCT/JP2014/002018, dated Jul. 8, 2014, and English translation thereof, 3 pages total.

*Primary Examiner* — Len Tran
*Assistant Examiner* — Claire Rojohn, III
(74) *Attorney, Agent, or Firm* — Hamre, Schumann, Mueller & Larson, P.C.

(57) ABSTRACT

A fin-and-tube heat exchanger comprises: fins (31) which each have flat sections (35), first sloped sections (36), and second sloped sections (38); and heat transfer pipes (21). If a flat plane which is in contact, from the side opposite the crest of a ridge (34), with the upstream end and downstream end of the first sloped sections (36) in the air flow direction is a reference flat plane (H1), the angle between the reference flat plane (H1) and each of the second sloped sections (38) measured in a region upstream of a through-hole in the air flow direction is θ2, then the range of θ2 is determined by the relationship $0° < \theta 2 < \tan^{-1}[(L \pm \alpha)/\{(S1-D1)/2-L/\tan \theta 1\}]$.

3 Claims, 19 Drawing Sheets

(51) Int. Cl.
*F28F 1/32* (2006.01)
*F28D 1/047* (2006.01)

(58) Field of Classification Search
USPC ..... 165/151, 181, 182
See application file for complete search history.

(56) References Cited

U.S. PATENT DOCUMENTS 4,300,629 A * 11/1981 Hatada ..... F28F 1/325 165/151
4,691,768 A * 9/1987 Obosu ..... F28F 1/325 165/151
4,705,105 A * 11/1987 Cur ..... F28F 1/325 165/151
4,860,822 A * 8/1989 Sacks ..... F28F 1/325 165/151
4,923,002 A * 5/1990 Haussmann ..... F28F 1/32 165/151
5,056,594 A * 10/1991 Kraay ..... F28F 1/325 165/151
5,203,403 A * 4/1993 Yokoyama ..... F28F 1/32 165/151
5,207,270 A * 5/1993 Yokoyama ..... F28F 1/325 165/151
5,722,485 A * 3/1998 Love ..... F28F 1/325 165/151
5,775,413 A * 7/1998 Kawanabe ..... F28F 1/32 165/151
5,927,393 A * 7/1999 Richter ..... F28F 1/32 165/151
6,976,529 B2 * 12/2005 Kester ..... F28F 1/325 165/151
7,261,147 B2 * 8/2007 Oh ..... F28D 1/0477 165/151
8,973,647 B2 * 3/2015 Seo ..... F24F 13/30 165/151
8,978,743 B2 * 3/2015 Tamura ..... F24F 1/18 165/151
2004/0050539 A1 3/2004 Bemisderfer
2005/0045316 A1 * 3/2005 Oh ..... F28F 1/32 165/150
2005/0056407 A1 * 3/2005 Oh ..... F28F 1/32 165/151
2008/0190588 A1 * 8/2008 Heidenreich ..... F28D 1/024 165/151

FOREIGN PATENT DOCUMENTS

JP 11125495 A * 5/1999
JP 2000-193389 7/2000
JP 2005-539193 12/2005
JP 2013-019578 1/2013

* cited by examiner

FIN-AND-TUBE HEAT EXCHANGER AND REFRIGERATION CYCLE DEVICE

TECHNICAL FIELD

The present invention relates to a fin tube heat exchanger, and a refrigeration cycle apparatus in which a refrigeration cycle is configured with use of the fin tube heat exchanger for heat exchange.

BACKGROUND ART

A fin tube heat exchanger is composed of a plurality of fins arranged at a predetermined distance, and a heat transfer tube penetrating the plurality of fins. Air flows between the fins, and exchanges heat with fluid inside the heat transfer tube.

FIGS. 9A to 9D are, respectively, a plan view of a fin in a conventional fin tube heat exchanger, a sectional view taken along line IXB-IXB, a sectional view taken along line IXC-IXC, and a sectional view taken along line IXD-IXD.

Fin 10 is shaped such that peak portion 4 and trough portion 6 appear alternately in the air stream direction. Such a fin is generally referred to as "corrugated fin." The use of the corrugated fin makes it possible to obtain not only the effect of increasing a heat transfer area, but also the effect of thinning a temperature boundary layer by allowing air stream 3 to be serpentine.

FIGS. 10A to 10C are, respectively, a plan view of another fin in the conventional fin tube heat exchanger, a sectional view taken along line XB-XB, and a sectional view taken along line XC-XC. As illustrated in FIGS. 10A to 10C, a technique has been known in which the corrugated fin is provided with cut-and-raised portions to improve heat transfer performance (Patent Literature (hereinafter, referred to as "PTL") 1).

Fin inclined surfaces 42*a*, 42*b*, 42*c* and 42*d* of fin 1 are provided with portions raised by cutting (hereinafter, referred to as "cut-and-raised portions") 41*a*, 41*b*, 41*c* and 41*d*. When the distance between adjacent fins 1 is set as Fp, the respective heights H1, H2, H3 and H4 of cut-and-raised portions 41*a*, 41*b*, 41*c* and 41*d* satisfy the relationship: $1/5 \cdot Fp \leq (H1, H2, H3, H4) \leq 1/3 \cdot Fp$.

PTL 1 also discloses another fin configured to reduce the ventilation resistance during frost formation operation as much as possible. FIGS. 11A to 11C are, respectively, a plan view of yet another fin in the conventional fin tube heat exchanger, a sectional view taken along line XIB-XIB, and a sectional view taken along line XIC-XIC.

As illustrated in FIGS. 11A to 11C, fin inclined surfaces 12*a* and 12*b* of fin 1 are provided with cut-and-raised portions 11*a* and 11*b* which satisfy the above-mentioned relationship. Since fin 1 is bent fewer times, the inclination angles of fin inclined surfaces 12*a* and 12*b* are relatively gentle.

CITATION LIST

Patent Literature

PTL 1
Japanese Patent Application Laid-Open No. 11-125495

SUMMARY OF INVENTION

Technical Problem

Even when the cut-and-raised portion is sufficiently low, however, the cross-sectional area of a passage decreases locally by 20% or more during the frost formation operation. Therefore, in a case where a cut-and-raised portion is provided, even when the number of times of bending is limited to one to make the inclination angle gentle, significant increase of the ventilation resistance is unavoidable.

In order to reduce the ventilation resistance of fin 1 illustrated in FIGS. 11A to 11C to a level equivalent to that of fin 10 illustrated in FIGS. 9A to 9D, it becomes necessary to make the inclination angle of fin 10 as closer to 0° as possible.

An object of the present invention is to provide a fin tube heat exchanger and a refrigeration cycle apparatus having an excellent basic performance, respective of whether they are during frost formation operation or during non-frost formation operation.

Solution to Problem

The fin tube heat exchanger according to the present invention is a fin tube heat exchanger including a plurality of fins arranged in parallel for forming a gas passage, and a heat transfer tube penetrating the plurality of fins, the heat transfer tube being configured to allow a medium that exchanges heat with the gas to flow through the heat transfer tube, in which each of the fins is a corrugated fin shaped such that a peak portion appears only at one location in an air stream direction, the fins each including a plurality of through holes into which the heat transfer tube is fitted, a flat portion formed around the through hole, a first inclined portion being inclined relative to the air stream direction so as to form the peak portion, and a second inclined portion connecting the flat portion and the first inclined portion, the plurality of through holes are formed along a step direction perpendicular to both a direction in which the plurality of fins are arranged and the air stream direction, and when a distance from an upstream end to a downstream end of the first inclined portion in the air stream direction is defined as S1, a distance from an upstream end to a downstream end of the flat portion in the air stream direction is defined as D1, a plane contacting the upstream end and the downstream end of the first inclined portion in the air stream direction from a side opposite to an apex side of the peak portion is defined as a reference plane, an angle formed between the reference plane and the first inclined portion is defined as θ1, an angle formed between the reference plane and the second inclined portion in an area on an upstream side in the air stream direction as viewed from the through hole is defined as θ2, a distance from the reference plane to the flat portion is defined as α, and a distance between the reference plane of one of the fins and the reference plane of another of the fins adjacent to the apex side of the peak portion is defined as L, in a case where the flat portion is on a side same as the apex side of the peak portion with respect to the reference plane, or in a case of α=0, the following relationship holds true:

$$\theta° < \theta2 < \tan^{-1}[(L-\alpha)/\{(S1-D1)/2-L/\tan\theta1\}], \text{ and}$$

in a case where the flat portion is on a side opposite to the apex side of the peak portion with respect to the reference plane, the following relationship holds true:

$$\theta° < \theta2 < \tan^{-1}[(L+\alpha)/\{(S1-D1)/2-L/\tan\theta1\}].$$

The refrigeration cycle apparatus according to the present invention is a refrigeration cycle apparatus in which a refrigeration cycle is configured such that a refrigerant circulates through a compressor, a condenser, a diaphragm apparatus and an evaporator, in which at least one of the condenser and the evaporator includes the above-mentioned fin tube heat exchanger.

Advantageous Effects of Invention

According to the present invention, it is possible to provide the fin tube heat exchanger and the refrigeration cycle apparatus having an excellent basic performance, irrespective of whether during frost formation operation or during non-frost formation operation.

DESCRIPTION OF EMBODIMENT

Hereinafter, an embodiment of the present invention will be described with reference to the drawings. It is noted that the present invention is not construed to be limited by the embodiment.

Figure 1:
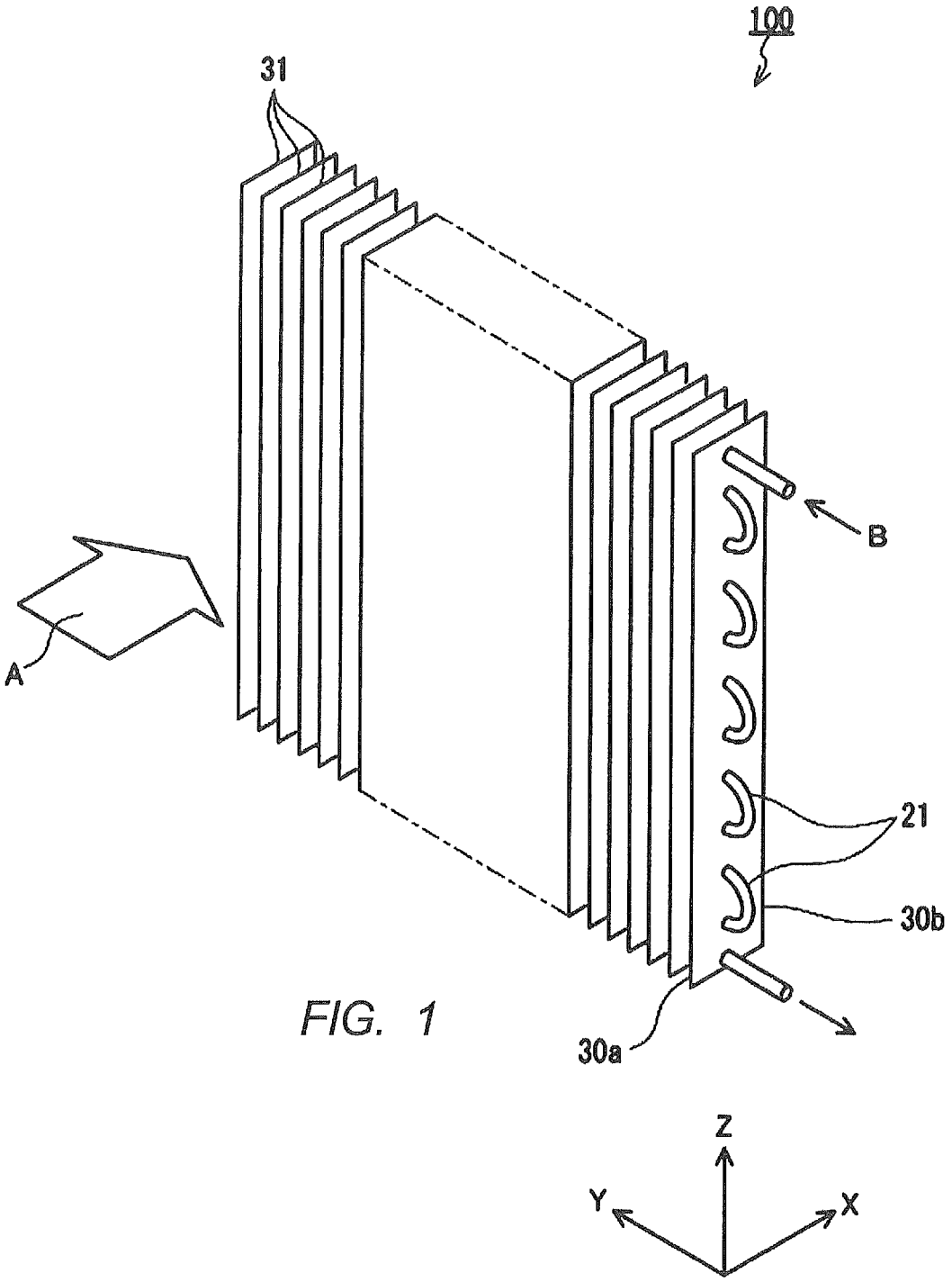
FIG. 1 is a diagram illustrating an example of a fin tube heat exchanger according to the embodiment of the present invention.

FIG. 1 is a diagram illustrating an example of fin tube heat exchanger 100 according to the embodiment of the present invention. As illustrated in FIG. 1, fin tube heat exchanger 100 according to the present embodiment includes a plurality of fins 31 arranged in parallel for forming a passage of air A (gas), and heat transfer tubes 21 penetrating these fins 31.

Fin tube heat exchanger 100 is configured to exchange heat between medium B flowing inside heat transfer tube 21 and air A flowing along the surface of fin 31. Medium B is, for example, a refrigerant such as carbon dioxide, or hydrofluorocarbon. Heat transfer tube 21 may be either a single connected tube, or a plurality of separated tubes.

Fin 31 has front edge 30*a* and rear edge 30*b*. Both front edge 30*a* and rear edge 30*b* are linear. In the present embodiment, fin 31 has a bilaterally symmetrical structure with respect to the center of heat transfer tube 21. Accordingly, there is no need to consider the direction of fin 31 when assembling heat exchanger 100.

In the present embodiment, the direction in which fins 31 are arranged is defined as height direction (Y direction in FIG. 1), the direction parallel to front edge 30*a* is defined as step direction (Z direction in FIG. 1), and the direction perpendicular to the height direction and the step direction is defined as air stream direction (flow direction of air A: X direction in FIG. 1). In other words, the step direction is a direction perpendicular to both the height direction and the air stream direction.

Figure 2A:
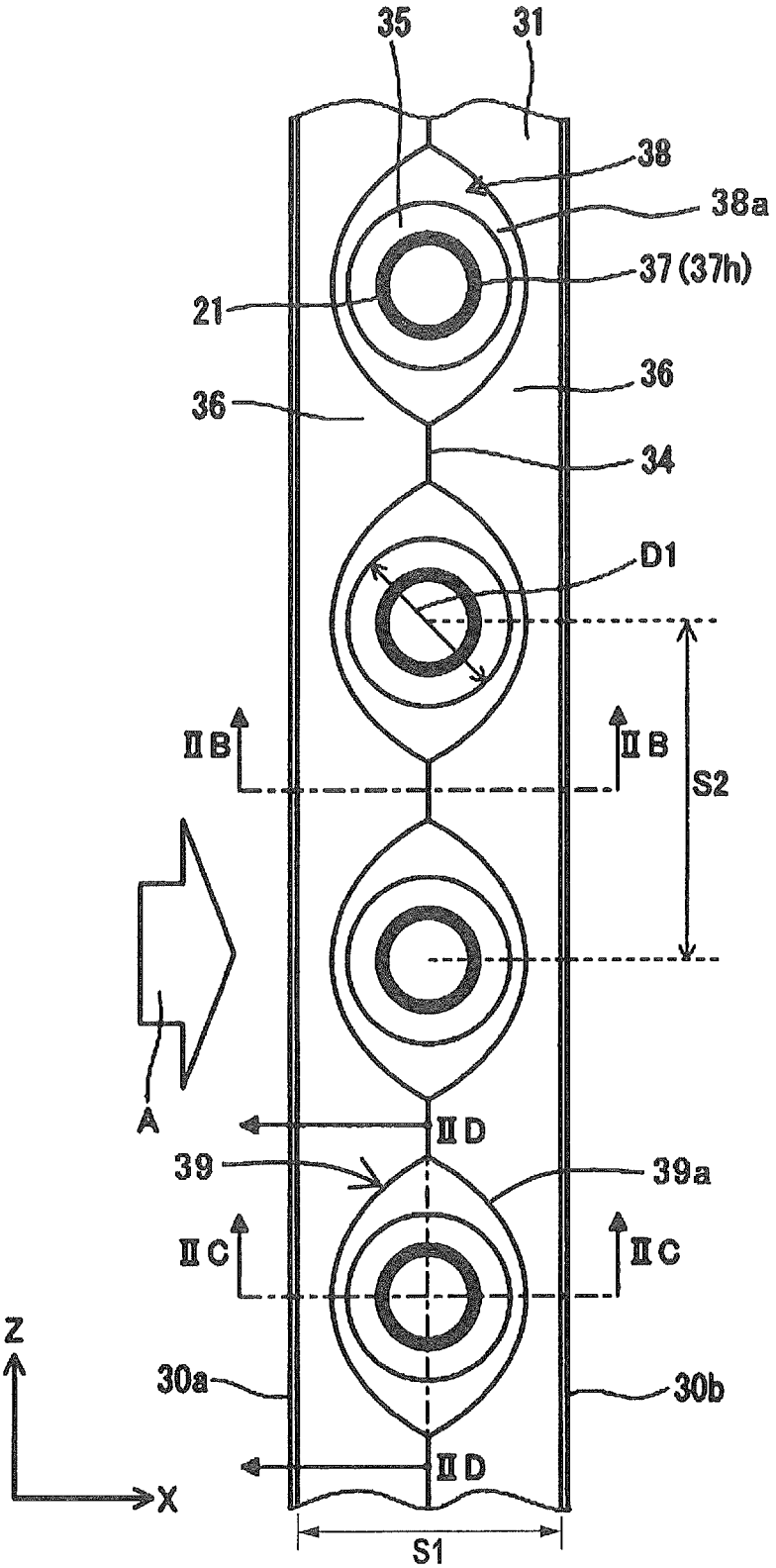
FIG. 2A is a plan view illustrating an example of a fin to be used for the fin tube heat exchanger of FIG. 1.
Figure 2B:
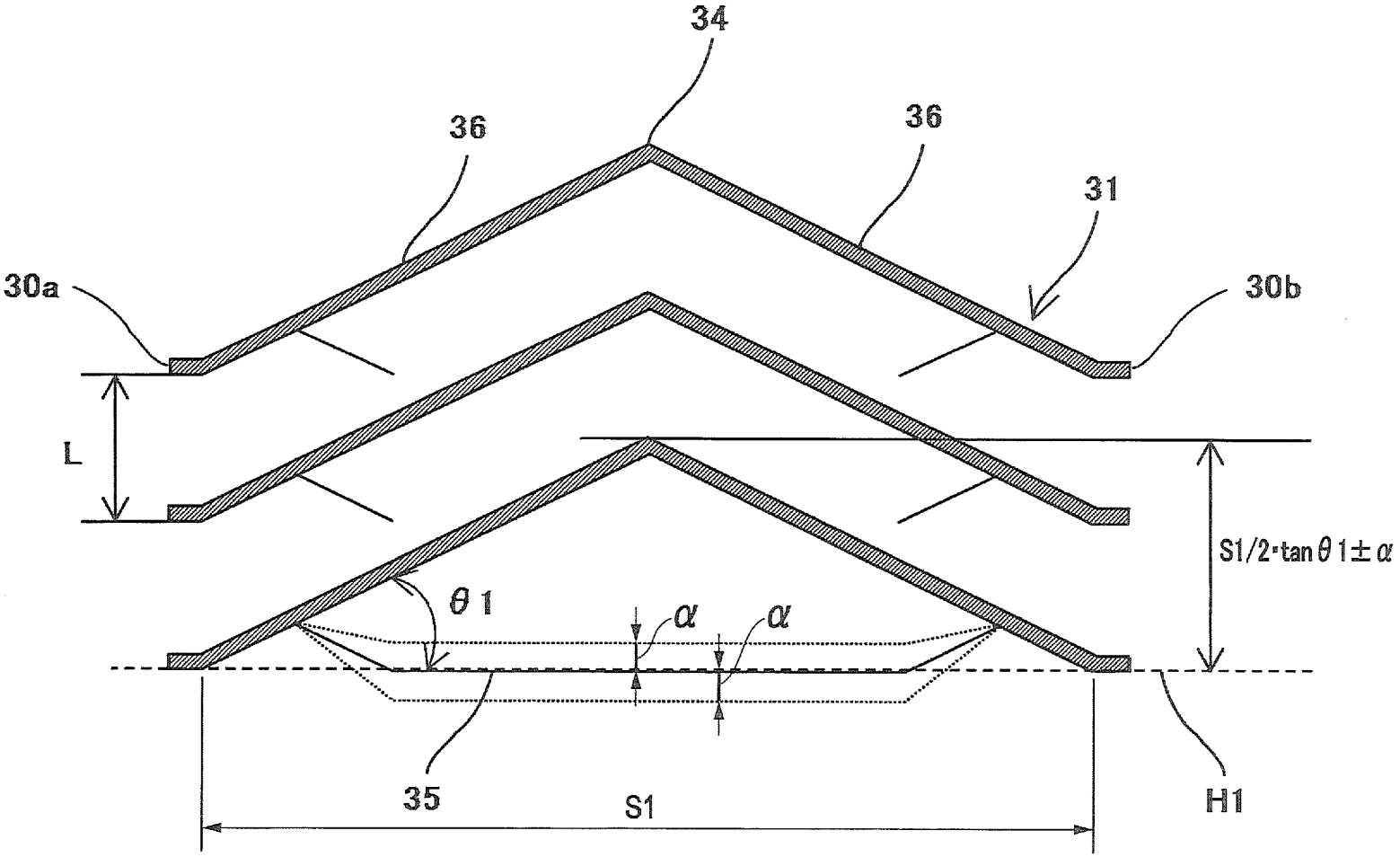
FIG. 2B is a sectional view illustrating a cross-section of the fin illustrated in FIG. 2A, when the fin is cut by a plane along line IIB-IIB.
Figure 2C:
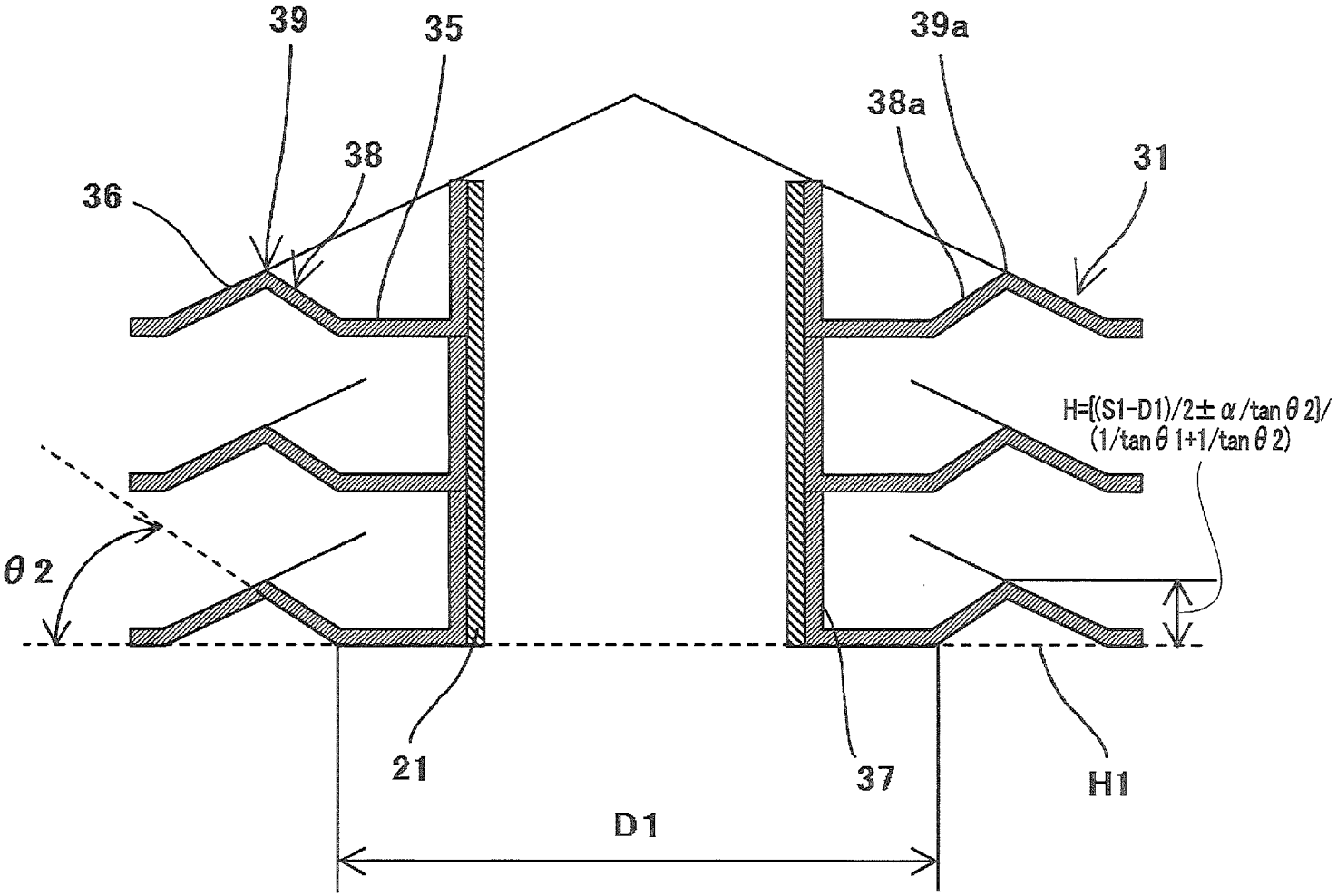
FIG. 2C is a sectional view illustrating a cross-section of the fin illustrated in FIG. 2A, when the fin is cut by a plane along line IIC-IIC.
Figure 2D:
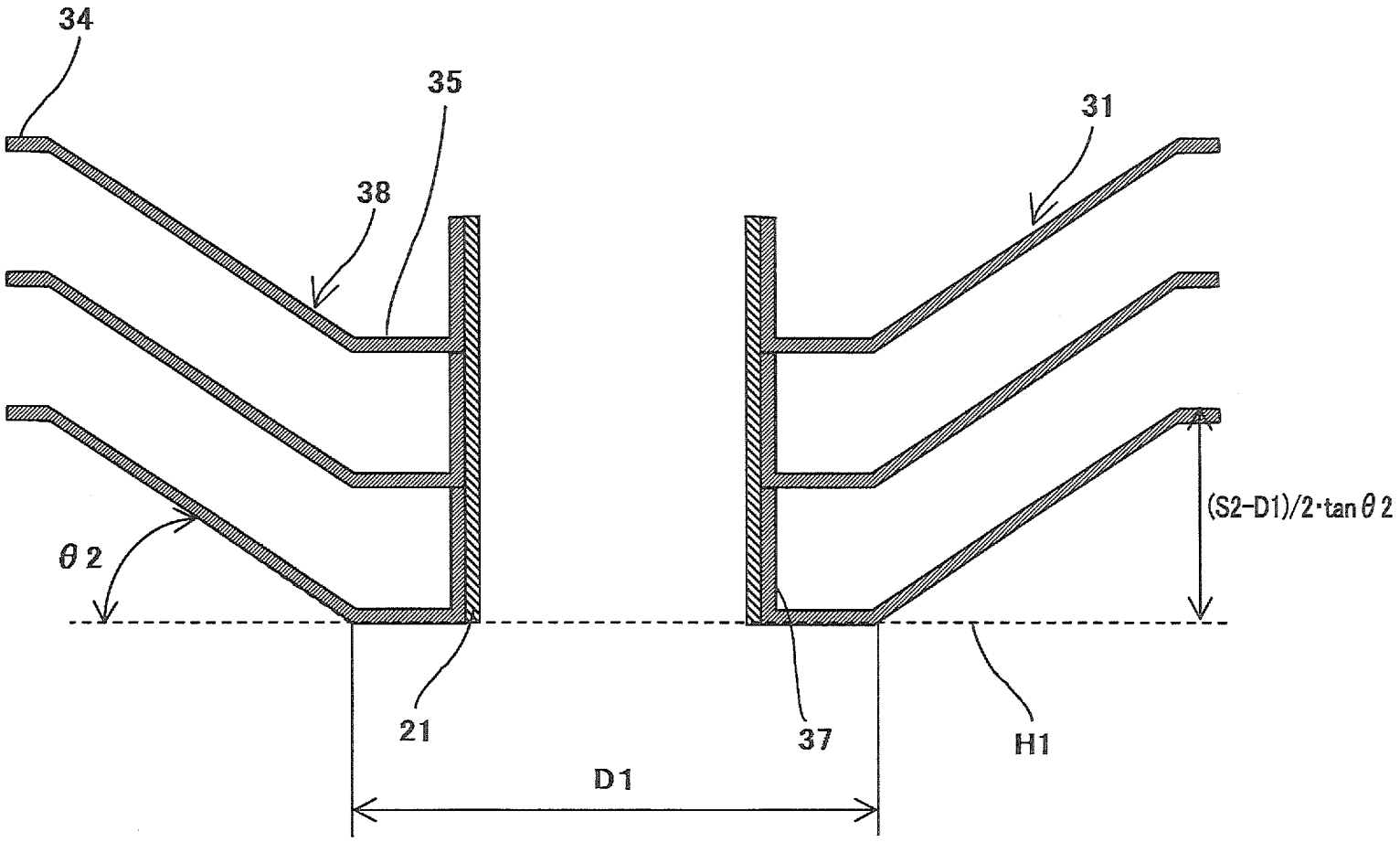
FIG. 2D is a sectional view illustrating a cross-section of the fin illustrated in FIG. 2A, when the fin is cut by a plane along line IID-IID.

FIG. 2A is a plan view illustrating an example of a fin to be used for fin tube heat exchanger 100 of FIG. 1. FIG. 2B is a sectional view illustrating a cross-section of the fin illustrated in FIG. 2A, when the fin is cut by a plane along line IIB-IIB. FIG. 2C is a sectional view illustrating a cross-section of the fin illustrated in FIG. 2A, when the fin is cut by a plane along line IIC-IIC. FIG. 2D is a sectional view illustrating a cross-section of the fin illustrated in FIG. 2A, when the fin is cut by a plane along line IID-IID.

As illustrated in FIGS. 2A to 2D, fin 31 typically has a rectangular and planar shape. The longitudinal direction of fin 31 coincides with the step direction. In the present embodiment, fins 31 are arranged at a constant interval (fin pitch). The fin pitch is adjusted to a range of from 1.0 to 2.0 mm, for example. As illustrated in FIG. 2B, the fin pitch is indicated by distance L between two adjacent fins 31.

A portion with a certain width including front edge 30*a* and a portion with a certain width including rear edge 30*b* are parallel to the air stream direction. These portions, however, are portions used for fixing fin 31 to a die when shaping, and have an extremely narrow width, so that these portions have no large influence on the performance of fin 31.

As a material for fin 31, a planar plate made of punched aluminum having a wall thickness of 0.05 to 0.8 mm can be suitably used. The surface of fin 31 may undergo a hydrophilic treatment such as boehmite treatment or coating with a hydrophilic paint. It is also possible to perform a water repellent treatment in place of the hydrophilic treatment.

In fin 31, a plurality of through holes 37*h* are formed in a row and at an equal interval along the step direction. A straight line passing through the respective centers of the plurality of through holes 37*h* is parallel to the step direction. Heat transfer tube 21 is fitted into each of the plurality of through holes 37*h*.

Further, around through hole 37*h*, cylindrical fin collar 37 is formed of a part of fin 31, and this fin collar 37 and heat transfer tube 21 are closely contacted with each other. The diameter of through hole 37*h* is 1 to 20 mm, for example. That is, the diameter of through hole 37*h* may be 4 mm or less.

The diameter of through hole 37*h* coincides with the outer diameter of heat transfer tube 21. The center-to-center distance (tube pitch) between two adjacent through holes 37*h* in the step direction is, for example, two to three times the diameter of through hole 37*h*. Further, the length of fin 31 in the air stream direction is, for example, 15 to 25 mm.

As illustrated in FIGS. 2A and 2B, a portion protruding in the same direction as the direction in which fin collar 37 protrudes is defined as peak portion 34. In the present embodiment, fin 31 only has one peak portion 34 in the air stream direction.

The ridge line of peak portion 34 is parallel to the step direction. That is, fin 31 is a fin referred to as corrugated fin. Front edge 30*a* and rear edge 30*b* correspond to the trough portion. In the air stream direction, the position of peak portion 34 coincides with the center position of heat transfer tube 21.

In the present embodiment, fin 31 is configured to inhibit the flow of air A from the front side (upper surface side) to the rear side (lower surface side) of this fin 31 in an area other than the plurality of through holes 37*h*. It is desirable that fin 31 is not provided with an opening other than through holes 37*h*, as in the above-described configuration.

The absence of an opening is advantageous in terms of pressure loss. This is because a problem of clogging due to frost forming does not occur in this case. It is noted that the phrase "not provided with an opening" means that fin 31 is not provided with a slit, a louver or the like, i.e., a through hole penetrating the fin.

Fin 31 further includes flat portion 35, first inclined portion 36, and second inclined portion 38. Flat portion 35 is an annular portion being adjacent to fin collar 37 and formed around through hole 37*h*. The surface of flat portion 35 is parallel to the air stream direction and perpendicular to the height direction. First inclined portion 36 is a portion inclined to the air stream direction so as to form peak portion 34.

First inclined portion 36 occupies the largest area in fin 31. The surface of first inclined portion 36 is flat. First inclined portion 36 is parallel to the step direction, and is positioned at the right and left of the reference line passing through the centers of heat transfer tubes 21. That is, peak portion 34 is composed of first inclined portion 36 on the upwind side and first inclined portion 36 on the downwind side.

Second inclined portion 38 is a portion smoothly connecting flat portion 35 and first inclined portion 36 so as to eliminate the height difference between flat portion 35 and first inclined portion 36, and the surface of second inclined portion 38 is formed of a gently curved surface.

Ridge line portion 39 is formed of first inclined portion 36 and second inclined portion 38. Flat portion 35 and second inclined portion 38 form a recessed portion around fin collar 37 and through hole 37*h*.

It is noted that ridge line portion 39 which is a boundary portion between first inclined portion 36 and second inclined portion 38 may be provided with a moderate radius (e.g., R 0.5 mm to R 2.0 mm). Likewise, a boundary portion between peak portion 34 and second inclined portion 38 may be provided with a moderate radius (e.g., R 0.5 mm to R 2.0 mm). Such a radius improves drainage properties of fin 31.

Here, as illustrated in FIGS. 2A to 2D, the distance from the upstream end to the downstream end of first inclined portion 36 in the air stream direction is defined as S1. The center-to-center distance (tube pitch) between portions of heat transfer tube 21 in the step direction is defined as S2. The diameter of flat portion 35 is defined as D1. A plane contacting the upstream end and the downstream end of first inclined portion 36 in the air stream direction from the side opposite to the apex side of the peak portion 34 is defined as reference plane H1. The distance (fin pitch) between reference, plane H1 of one fin 31 and reference plane H1 of another fin 31 adjacent to the apex side of peak portion 34 is defined as L.

The upstream end and the downstream end of first inclined portion 36 are connected, respectively, to front edge 30*a* and rear edge 30*b*. Further, an angle formed between reference plane H1 and first inclined portion 36 is defined as θ1. An angle formed between reference plane H1 and second inclined portion 38 is defined as θ2.

Angle θ1 is an angle on the acute side, out of angles formed between reference plane H1 and first inclined portion 36. Likewise, angle θ2 is an angle on the acute side, out of angles formed between reference plane H1 and second inclined portion 38. In the present embodiment, angle θ1 and angle θ2 are referred to as "first inclination angle θ1" and "second inclination angle θ2", respectively.

Further, the distance from reference plane H1 to flat portion 35 is defined as α. In the embodiment illustrated in FIGS. 2A to 2D, distance α is zero. That is, in the height direction, the positions of flat portion 35, the upstream end of first inclined portion 36, the downstream end of first inclined portion 36, front edge 30*a*, and rear edge 30*b* coincide with one another. At that time, reference plane H1 coincides with a plane including the surface of flat portion 35.

As described above, when S1, S2, D1, θ1, θ2, α, and L are defined, fin tube heat exchanger 100 satisfies the following expression (1):

$$\tan^{-1}\{2\cdot L/(S2-D1)\}<\theta 2<\tan^{-1}[(L\pm\alpha)/\{(S1-D1)/2-L/\tan\theta 1\}] \quad (1).$$

The position of flat portion 35 may differ from the positions of front edge 30*a* and rear edge 30*b* in the height direction. Specifically, when flat portion 35 is positioned closer to the apex of peak portion 34 than reference plane H1, the right-hand side of the expression (1) is:

$$\tan^{-1}[(L-\alpha)/\{(S1-D1)/2-L/\tan\theta 1\}].$$

When flat portion 35 is positioned closer to the apex of peak portion 34 than reference plane H1, the angle formed between first inclined portion 36 and second inclined portion 38 becomes large, thus reducing pressure loss, although the surface area of fin 31 decreases. That is, fin 31 with less pressure loss is obtained.

On the other hand, when flat portion 35 is more distant from the apex of peak portion 34 than reference plane H1, the right-hand side of the expression (1) is:

$$\tan^{-1}[(L+\alpha)/\{(S1-D1)/2-L/\tan\theta1\}].$$

When flat portion 35 is more distant from the apex of peak portion 34 than reference plane H1, the angle formed between first inclined portion 36 and second inclined portion 38 becomes small, thus increasing the surface area of fin 31, although pressure loss increases.

It is noted that, although second inclined portion 38 has a curved surface as a whole, second inclination angle θ2 can be specified in the cross-section illustrated in FIG. 2C or 2D. The cross-section in FIG. 2C is a cross-section observed when fin 31 is cut by a plane being perpendicular to the step direction and passing through the center of heat transfer tube 21. The cross-section in FIG. 2D is a cross-section observed when fin 31 is cut by a plane being perpendicular to the flow direction and passing through the center of the heat transfer tube.

Figure 3A:
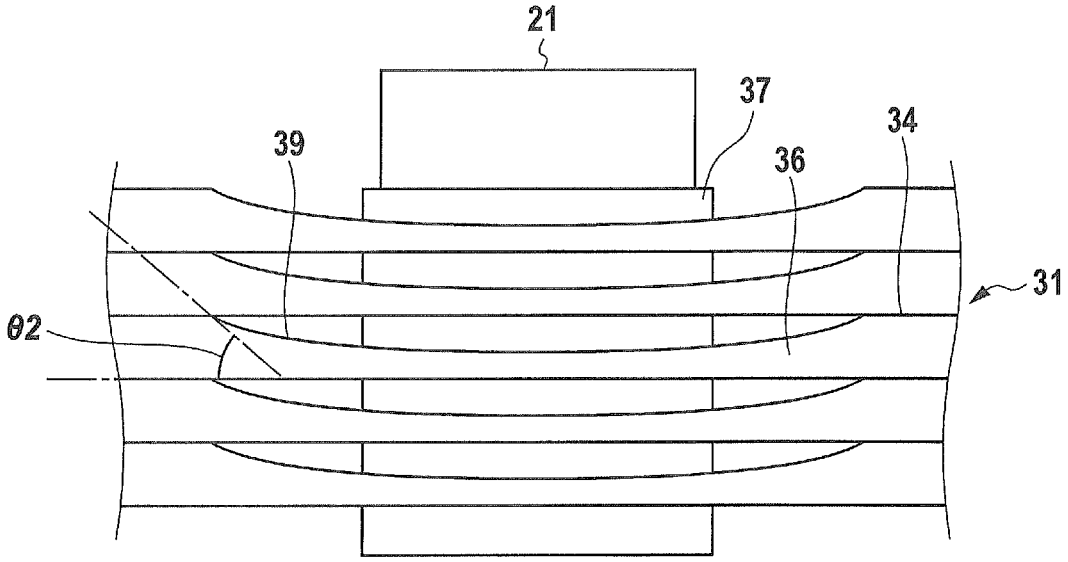
FIG. 3A is a side view illustrating an example of a fin tube heat exchanger.
Figure 3B:
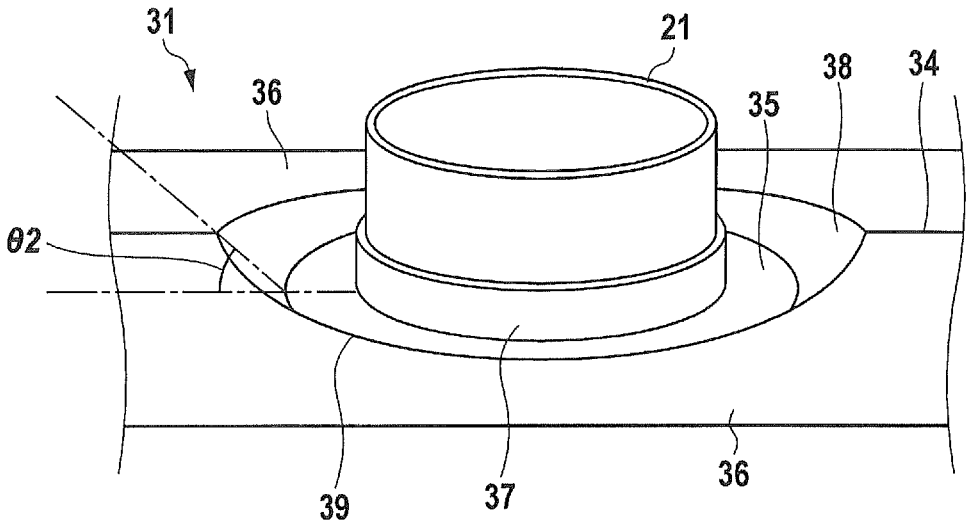
FIG. 3B is a perspective view illustrating an example of the shape of the fin.

FIG. 3A is a side view illustrating an example of fin tube heat exchanger 100. FIG. 3A is a diagram seen in the flow direction of air A (X direction) in FIG. 1. Further, FIG. 3B is a perspective view illustrating an example of the shape of fin 31.

As illustrated in FIG. 3A, in this fin tube heat exchanger 100, a gap is formed between heat transfer tubes 21 adjoining in the height direction (Y direction). As illustrated in FIG. 3B, this gap is caused by the position of ridge line portion 39 being lower than the position of peak portion 34 in the height direction.

Hereinafter, the technical significance of the expression (1) will be described in detail.

(Upper Limit Value of Second Inclination Angle θ2)

Figure 4A:
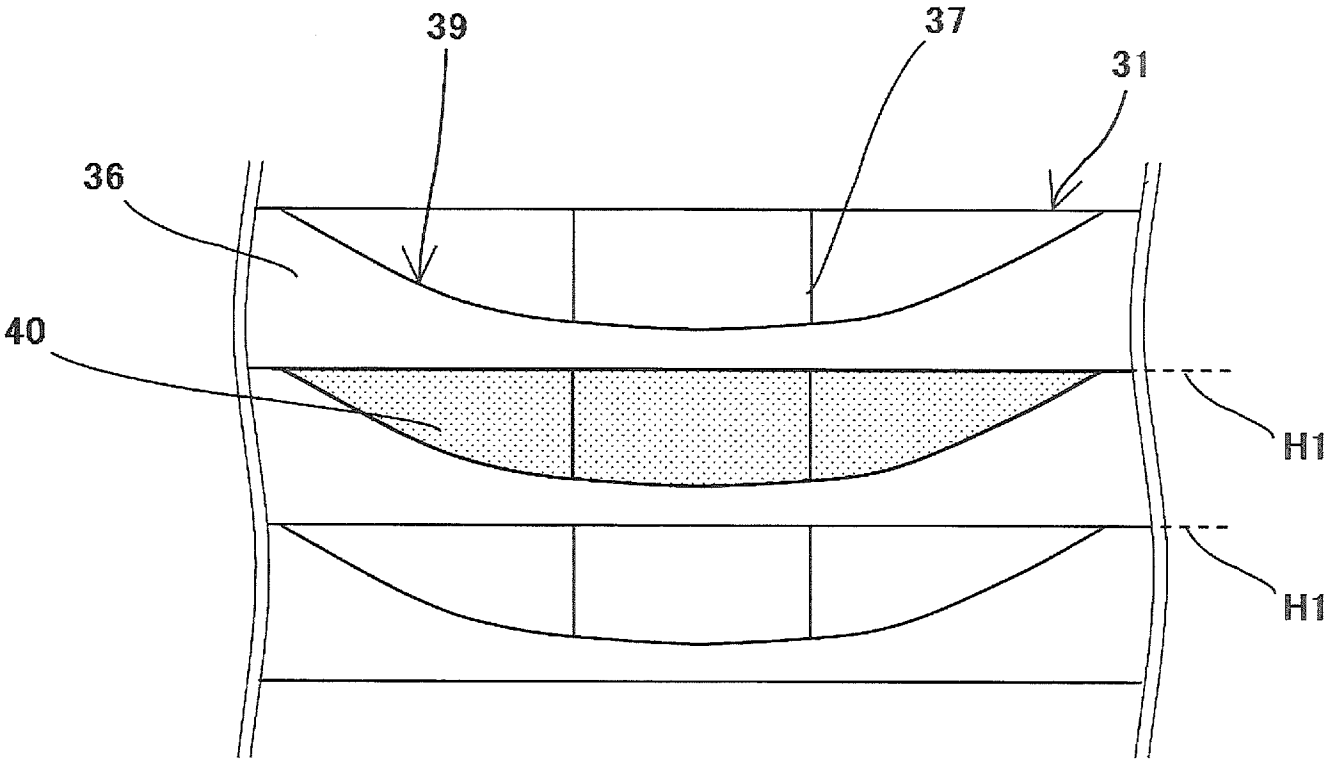
FIG. 4A is a diagram illustrating an example of a gap portion formed in the fin tube heat exchanger.
Figure 4B:
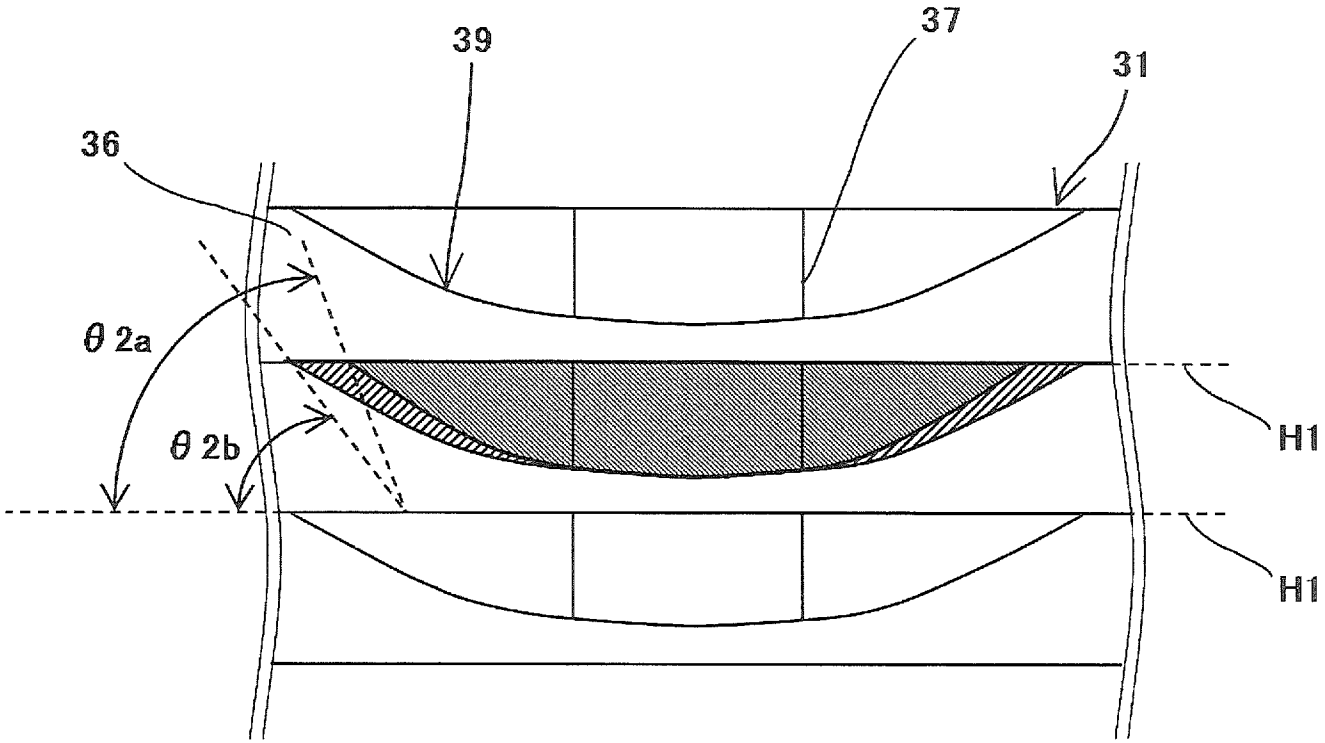
FIG. 4B is a diagram illustrating the change of the gap portion with respect to the change of second inclination angle θ2.

FIG. 4A is a diagram illustrating an example of gap portion 40 formed in fin tube heat exchanger 100. FIG. 4B is a diagram illustrating the change of gap portion 40 with respect to the change of second inclination angle θ2. FIGS. 4A and 4B illustrate gap portion 40 being formed between ridge line portion 39 of one fin 31 and reference plane H1 of another fin 31 adjacent to the apex side of peak portion 34 of one fin 31, when seen from the upstream end side of fin 31 in the air stream direction (flow direction of air A).

FIG. 4A illustrates gap portion 40 in a dotted pattern. This gap portion 40 is generated when the distance of protrusion of ridge line portion 39 on fin collar 37 side is smaller than distance L between reference plane H1 of one fin 31 and reference plane H1 of another fin 31 adjacent to the apex side of peak portion 34.

The threshold angle θ2U at which the distance of protrusion of ridge line portion 39 on fin collar 37 side is equal to the above-mentioned distance L is represented by the following expression (2):

$$\theta2U=\tan^{-1}[(L\pm\alpha)/\{(S1-D1)/2-L/\tan\theta1\}] \quad (2).$$

Here, S1 is a distance from the upstream end to the downstream end of first inclined portion 36 in the air stream direction, D1 is a diameter of flat portion 35, θ1 is first inclination angle, and α is a distance from reference plane H1 to flat portion 35.

Figure 5A:
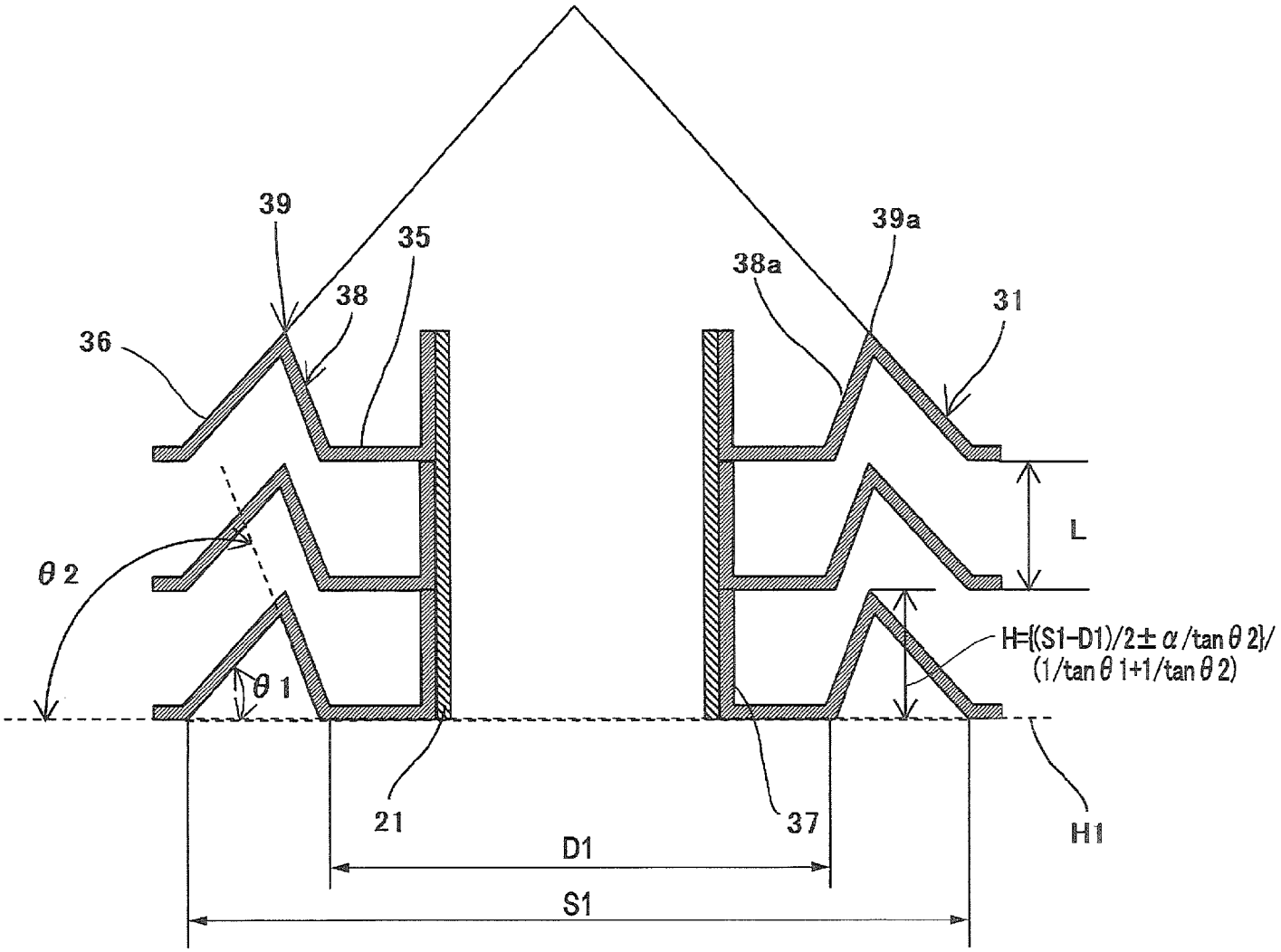
FIG. 5A is an explanatory diagram of a calculation method of upper limit angle θ2U.

This threshold angle θ2U is calculated according to the following method. FIG. 5A is an explanatory diagram of a calculation method of upper limit angle θ2U. As illustrated in FIG. 5A, distance H of protrusion of ridge line portion 39 on fin collar 37 side is represented by:

$$H=\{(S1-D1)/2\pm\alpha/\tan\theta2\}/(1/\tan\theta1+1/\tan\theta2).$$

When distance H of protrusion of ridge line portion 39 on fin collar 37 side is equal to distance L between reference plane H1 of one fin 31 and reference plane H1 of another fin 31 adjacent to the apex side of peak portion 34, distance L is represented by:

$$\{(S1-D1)/2\pm\alpha/\tan\theta2\}/(1/\tan\theta1+1/\tan\theta2).$$

Thus, the tangent of second inclination angle θ2 is represented by:

$$\tan\theta2=(L\pm\alpha)/\{(S1-D1)/2-L/\tan\theta1\},$$

and therefore threshold angle θ2U which is the upper limit of second inclination angle θ2 is represented as the expression (2).

The formation of such gap portion 40 allows air A to easily flow through gap portion 40 near heat transfer tube 21 through which medium B flows, thus promoting heat exchange at a location of fin 31 where the temperature difference relative to air A is the largest.

When second inclination angle θ2 is changed, the opening area of gap portion 40 is changed. As illustrated in FIG. 4B, when second inclination angle θ2 becomes small, the opening area of gap portion 40 becomes large, whereas when second inclination angle θ2 becomes large, the opening area of gap portion 40 becomes small.

When comparing the case where second inclination angle is θ2a with the case where second inclination angle is θ2b (θ2a>θ2b), the opening area in the case where second inclination angle is θ2a is an area of the portion indicated by right-downward oblique lines in FIG. 4B. On the other hand, the opening area in the case where second inclination angle is θ2b is the total area of the portions indicated by right-downward oblique lines and left-downward oblique lines in FIG. 4B.

When second inclination angle θ2 becomes large, the opening area of gap portion 40 becomes small, thus increasing the flow rate of air A passing through gap portion 40, which increases heat transfer coefficient on air A side at second inclined portion 38. Thus, the heat exchange amount (heat exchange capacity) in fin 31 increases.

On the other hand, when second inclination angle θ2 becomes small, the opening area of gap portion 40 becomes large, thus decreasing the flow rate of air A passing through gap portion 40, which decreases heat transfer coefficient on air A side at second inclined portion 38. Thus, the heat exchange amount (heat exchange capacity) in fin 31 decreases.

However, when second inclination angle θ2 exceeds threshold angle θ2U in the passage formed between reference plane H1 of one fin 31 and reference plane H1 of another fin 31 adjacent to the apex side of peak portion 34, gap portion 40 is not formed in the air stream direction (flow direction of air A).

Therefore, in order to enhance the heat exchange capacity of the fin tube heat exchanger, it is important to make second inclination angle θ2 larger in a range less than threshold angle θ2U. Thus, the flow rate of air A increases, making it possible to increase the heat exchange amount (heat exchange capacity) in fin 31.

Making second inclination angle θ2 as large as possible in a range more than 0° and less than threshold angle θ2U causes downstream side second inclined portion 38*a* (see FIG. 2A) located on the downstream side in the flow direction of air A to rise against the flow of air A. Thus, the flow of air A is made to be bent largely at downstream side second inclined portion 38*a*.

As a result, a bending effect is obtained which enables heat transfer to be promoted due to disturbance of the temperature boundary on the surface of the inclined surface at downstream side second inclined portion 38*a*, thus enhancing the heat exchange capacity of the fin tube heat exchanger.

Further, making second inclination angle θ2 as large as possible in the above-mentioned range causes downstream side ridge line portion 39*a* located on the downstream side in the flow direction of air A to be protruded against the flow of air A. As a result, a front edge effect is newly obtained also at downstream side ridge line portion 39*a*, thus enhancing the heat exchange capacity.

Figure 6A:
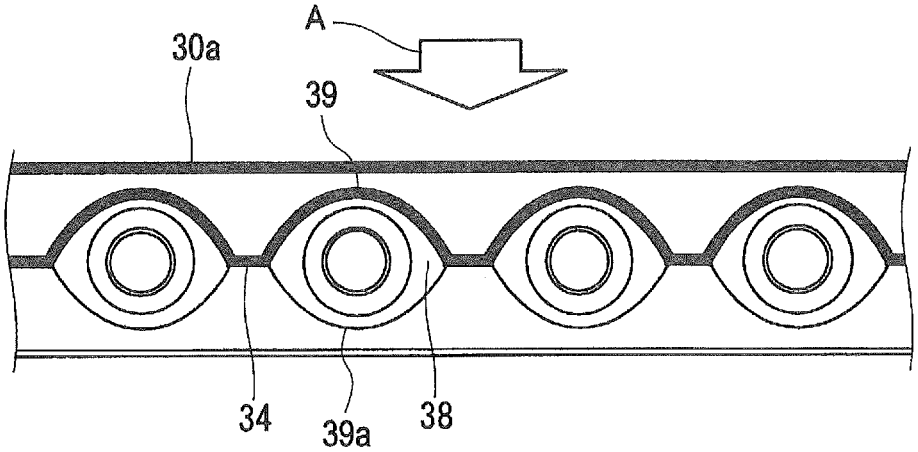
FIG. 6A is a plan view illustrating a portion having a high heat flow rate (heat exchange amount) in a case where second inclination angle θ2 is small.
Figure 6B:
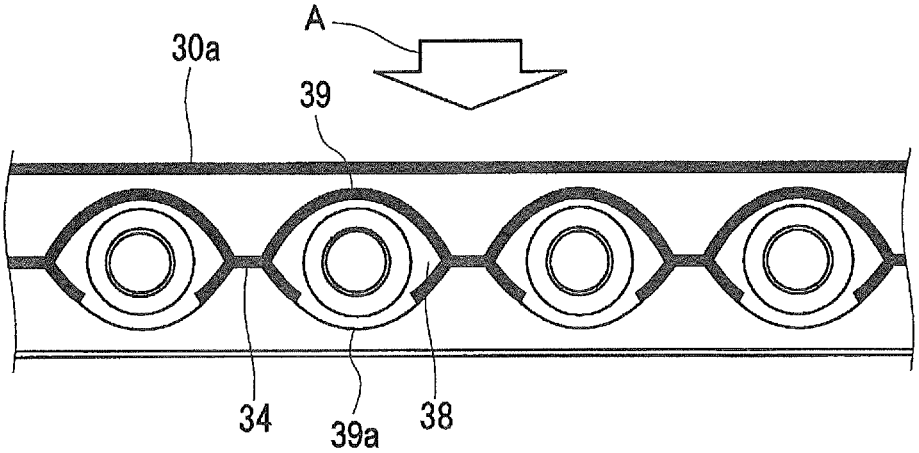
FIG. 6B is a plan view illustrating a portion having a high heat flow rate (heat exchange amount) in a case where second inclination angle θ2 is large.

FIG. 6A is a plan view illustrating a portion having a high heat flow rate (heat exchange amount) in the case where second inclination angle θ2 is small. FIG. 6B is a plan view illustrating a portion having a high heat flow rate (heat exchange amount) in the case where second inclination angle θ2 is large. Here, the portion having a high heat flow rate is indicated by a thick line. The above description is knowledge obtained based on the result of numerical analysis.

As can be seen from FIGS. 6A and 6B, when second inclination angle θ2 becomes large, the heat flow rate increases also at both ends of downstream side ridge line portion 39*a*. That is, at both ends of downstream side ridge line portion 39*a*, a front edge effect is newly obtained, thus enhancing the heat exchange capacity.

(Lower Limit Value of Second Inclination Angle θ2)

Figure 5B:
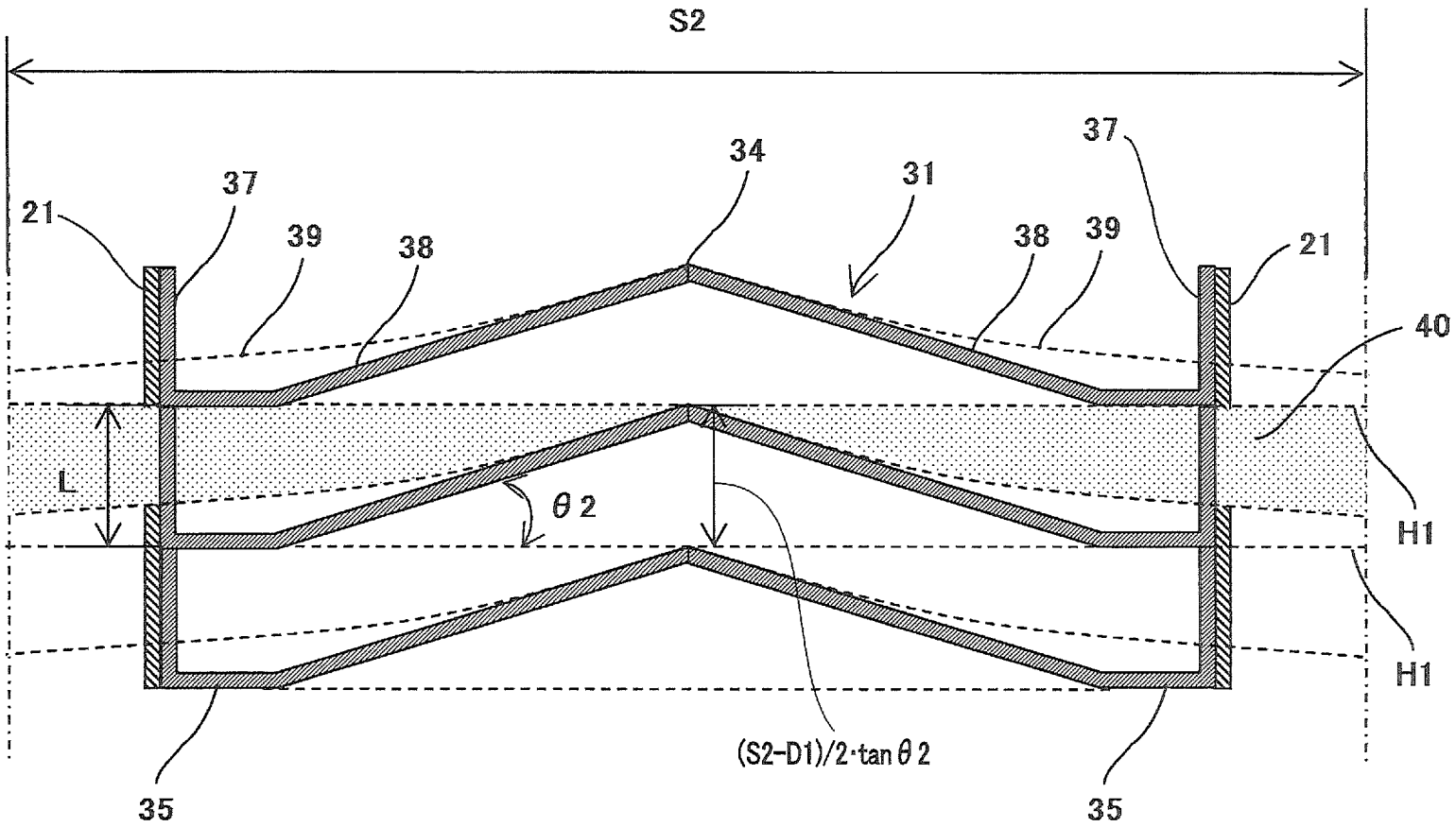
FIG. 5B is an explanatory diagram of a calculation method of lower limit angle θ2L.

FIG. 5B is an explanatory diagram of a calculation method of lower limit angle θ2L. As described above, the distance of protrusion of ridge line portion 39 on fin collar 37 side is made smaller than distance L between reference plane H1 of one fin 31 and reference plane H1 of another fin 31 adjacent to the apex side of peak portion 34.

Thus, gap portion 40 (dotted portion in FIG. 4B) is formed between ridge line portion 39 of one fin 31 and reference plane H1 of another fin 31 adjacent to the apex side of peak portion 34 of one fin 31, when seen from the upstream end side of fin 31 in the air stream direction (flow direction of air A).

Here, when the height of the apex of peak portion 34 is smaller than the above-mentioned distance L, gap portion 40 formed around fin collar 37 is connected to adjacent gap portion 40. In this case, the opening area of gap portion 40 becomes excessively large, thus decreasing the flow rate of air A compared to the case of a small opening area.

Further, air A also spreads in a direction perpendicular to the flow direction of air A, making it difficult to exert the bending effect at downstream side second inclined portion 38*a* and to exert the front edge effect at downstream side ridge line portion 39*a*. That is, it is more preferable that the openings of gap portions 40 around the respective fin collars 37 be formed so as to be independent of one another.

Threshold angle θ2L at which the openings of gap portions 40 are formed so as to be independent of one another is represented by the following expression (3):

$$\theta 2L=\tan^{-1}L/\{(S2-D1)/2\} \quad (3).$$

Here, S2 is a center-to-center distance between portions of the heat transfer tube in the step direction, D1 is a diameter of flat portion 35, θ1 is first inclination angle, α is a distance from reference plane H1 to flat portion 35, and L is a distance between reference plane H1 of one fin 31 and reference plane H1 of another fin 31 adjacent to the apex side of peak portion 34.

This threshold angle θ2L is calculated according to the following method. In FIG. 5B, when second inclination angle θ2 is made minimum, the height of peak portion 34 in the case where the openings of gap portions 40 are formed so as to be independent of one another is represented by (S2−D1)/2·tan θ2.

When the height of the apex of peak portion 34 is precisely equal to distance L, distance L is represented as: L=(S2−D1)/2·tan θ2, and thus the tangent of second inclination angle θ2 (=threshold angle θ2L) is represented as: tan θ2L=L/{(S2−D1)/2}. Accordingly, threshold angle θ2L can be represented by the above-mentioned expression (3).

Formation of such gap portion 40 allows air A to flow through gap portion 40 near heat transfer tube 21 through which medium B flows, thereby making it possible to further promote heat exchange at a location of fin 31 where the temperature difference relative to air A is the largest.

(Lower Limit Value of First Inclination Angle θ1)

Fin tube heat exchanger 100 in the present embodiment satisfies the following expression (4):

$$\tan^{-1}(2\cdot(L\pm\alpha)/S1)<\theta 1 \quad (4).$$

Thus, the openings of gap portions 40 around the respective fin collars 37 are formed so as to be independent of one another. As a result, it becomes possible to increase the flow rate of air A. Hereinafter, the technical significance of the expression (4) will be described in detail.

Figure 5C:
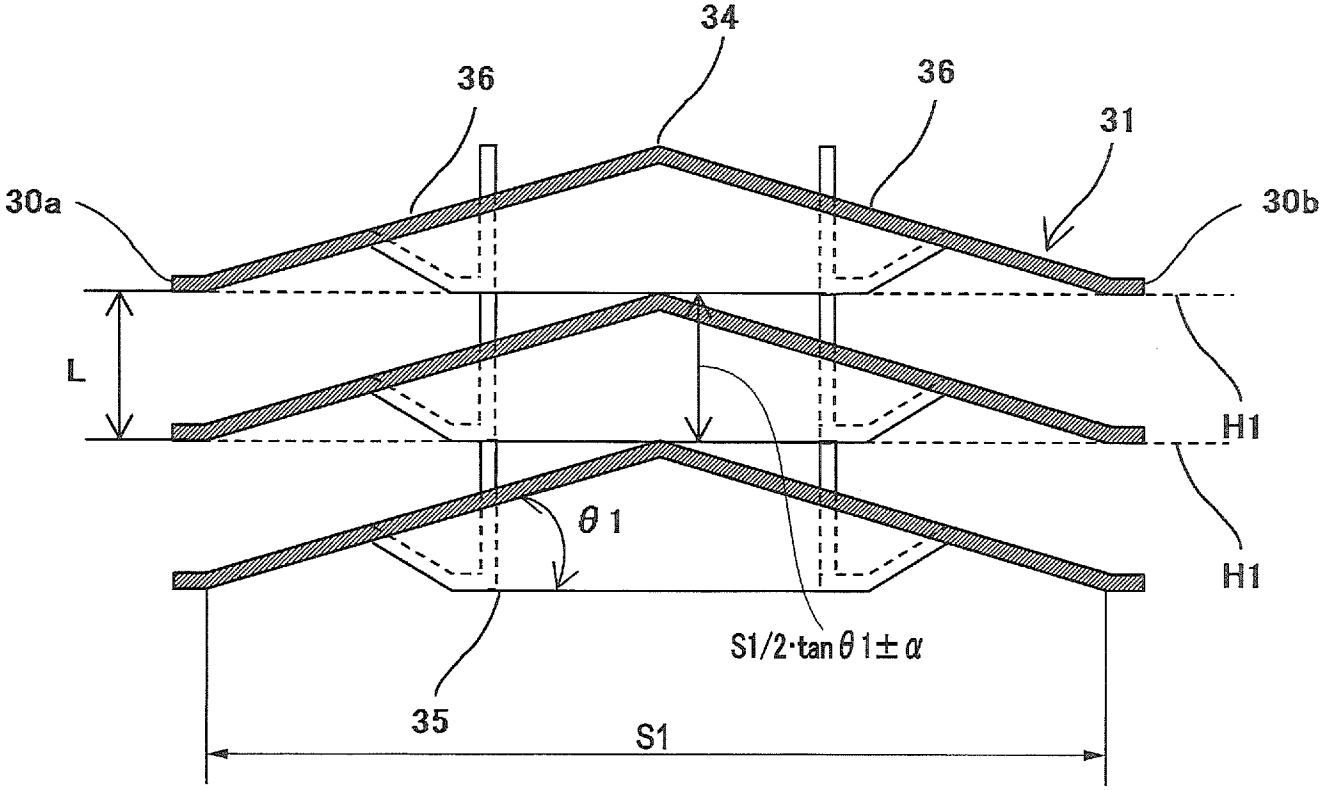
FIG. 5C is an explanatory diagram of a calculation method of lower limit angle θ1L.

FIG. 5C is an explanatory diagram of a calculation method of lower limit angle θ1L. As illustrated in FIG. 5C, the height of peak portion 34 from flat portion 35 of fin 31 is represented as: S1/2·tan θ1±α.

Here, S1 is a distance from the upstream end to the downstream end of first inclined portion 36 in the air stream direction, and a is a distance from reference plane H1 to flat portion 35.

The lower limit value θ1L of first inclination angle θ1 for forming the openings of gap portions 40 around the respective fin collars 37 so as to be independent of one another is represented by the following expression (5):

$$\theta 1L=\tan^{-1}\{2\cdot(L\pm\alpha)/S1\} \quad (5).$$

wherein, L is a distance between reference plane H1 of one fin 31 and reference plane H1 of another fin 31 adjacent to the apex side of peak portion 34.

As illustrated in FIG. 5C, when the height of the apex of peak portion 34 is precisely equal to distance L, distance L is represented as: L=S1/2·tan θ1±α, and thus the tangent of first inclination angle θ1 (=threshold angle θ1L) is represented as: tan θ1L=2·(L±α)/S1. Accordingly, the threshold angle θ1L can be represented by the expression (5).

As has been described above, in the present embodiment, the upper limit value of second inclination angle θ2 is determined using the expression (2). That is, second inclination angle θ2 is made to be included in the range described below.

(A) When flat portion 35 is on the side same as the apex side of peak portion 34 with respect to reference plane H1, or when α=0, $$\theta^\circ<\theta 2<\tan^{-1}[(L-\alpha)/\{(S1-D1)/2-L/\tan\theta 1\}] \quad (6), \text{ and}$$

(B) when flat portion 35 is on the side opposite to the apex side of peak portion 34 with respect to reference plane H1, $$\theta^\circ<\theta 2<\tan^{-1}[(L+\alpha)/\{(S1-D1)/2-L/\tan\theta 1\}] \quad (7).$$

Thus, gap portions 40 are formed between ridge line portion 39 of one fin 31 and reference plane H1 of another fin 31 adjacent to the apex side of peak portion 34 of one fin 31. As a result, air A easily flows through gap portion 40 near heat transfer tube 21 through which medium B flows, making it possible to promote heat exchange at a location of fin 31 where the temperature difference relative to air A is the largest.

It is noted that, a larger value of θ2 is preferred, because it leads to a smaller opening area of gap portion 40, thus resulting in an increase in the flow rate of air A.

Second inclination angle θ2 is preferably included in the following range:

$$\tan^{-1}L/\{(S2-D1)/2\}<\theta 2<90^\circ \quad (8).$$

First inclination angle θ1 is preferably included in the following range:

(A) When flat portion 35 is on the side same as the apex side of peak portion 34 with respect to reference plane H1, or when $\alpha=0$, $$\tan^{-1}(2\cdot(L-\alpha)/S1)<\theta 1<90^\circ \quad (9), \text{ and}$$

(B) when flat portion 35 is on the side opposite to the apex side of peak portion 34 with respect to reference plane H1, $$\tan^{-1}(2\cdot(L+\alpha)/S1)<\theta 1<90^\circ \quad (10).$$

Thus, the openings of gap portions 40 around the respective fin collars 37 are formed so as to be independent of one another. As a result, the opening area of gap portion 40 becomes small, thus making it possible to increase the flow rate of air A.

Figure 7:
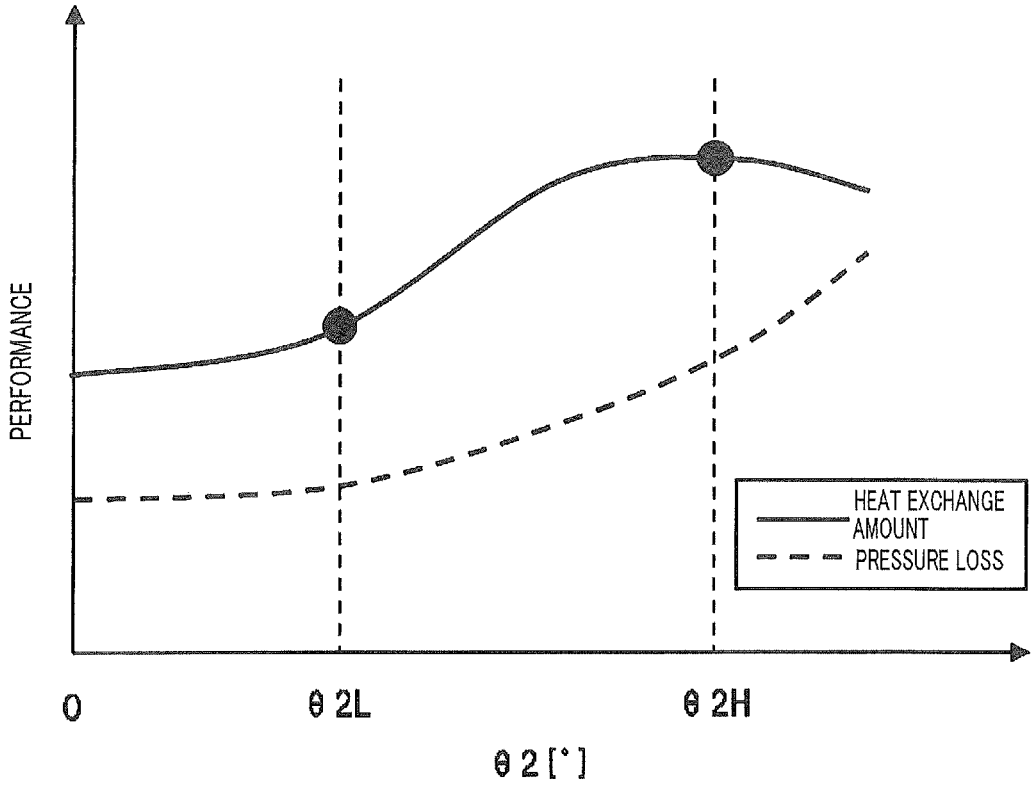
FIG. 7 is a diagram illustrating the relationship between second inclination angle θ2 and the performance (heat exchange amount and pressure loss) of the fin tube heat exchanger.

FIG. 7 is a diagram illustrating the relationship between second inclination angle θ2 and the performance (heat exchange amount and pressure loss) of fin tube heat exchanger 100.

As illustrated in FIG. 7, the heat exchange amount sharply increases when second inclination angle θ2 exceeds lower limit value θ2L represented by the expression (3). Then, when second inclination angle θ2 exceeds upper limit value θ2U represented by the expression (2), the heat exchange amount decreases. Further, the pressure loss sharply increases when second inclination angle θ2 exceeds upper limit value θ2U.

That is, setting second inclination angle θ2 within the range of the expression (1) makes it possible to secure a sufficient heat exchange amount, while suppressing ventilation resistance sufficiently.

In the above-mentioned embodiment, as illustrated in FIG. 3B, flat portion 35 and first inclined portion 36 are made to be connected smoothly with second inclined portion 38. In addition, as described in FIG. 5A, distance H of protrusion of ridge line portion 39 on fin collar 37 side is made smaller than distance L.

In the example illustrated in FIG. 3B, an angle on the acute side, out of angles formed between flat portion 35 and second inclined portion 38, is second inclination angle θ2 which is constant. Therefore, ridge line portion 39 which is an intersection line between first inclined portion 36 and second inclined portion 38 is a curve as illustrated in FIG. 3B.

Figure 8A:
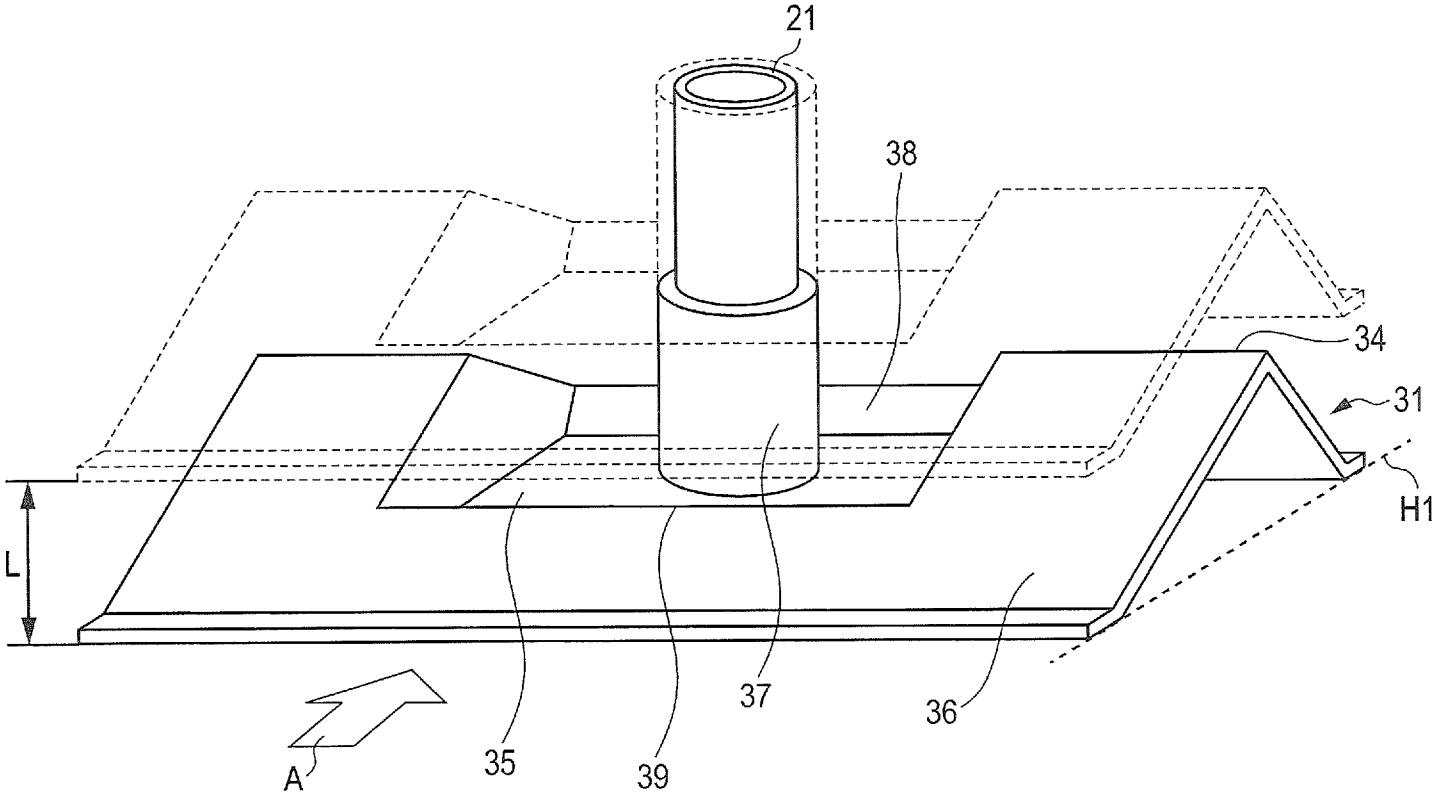
FIG. 8A is a diagram illustrating another example of the shape of the fin.

However, the shape of fin 31 is not limited to such a shape, and fin 31 may have other shapes. FIG. 8A is a diagram illustrating another example of the shape of fin 31. Ridge line portion 39 of this fin 31 is linear, unlike ridge line portion 39 of fin 31 illustrated in FIG. 3B.

Figure 8B:
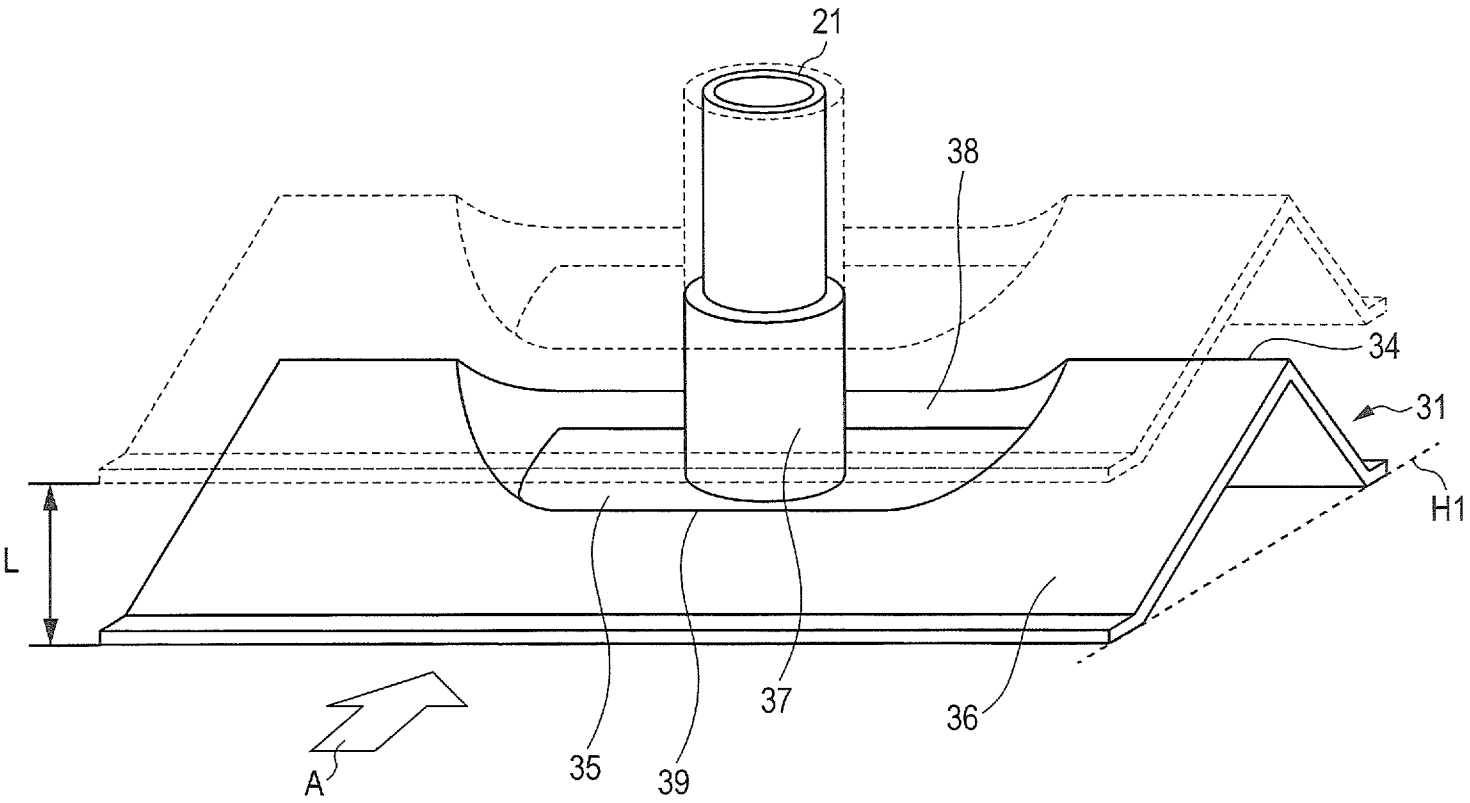
FIG. 8B is a diagram illustrating yet another example of the shape of the fin.
Figure 9A:
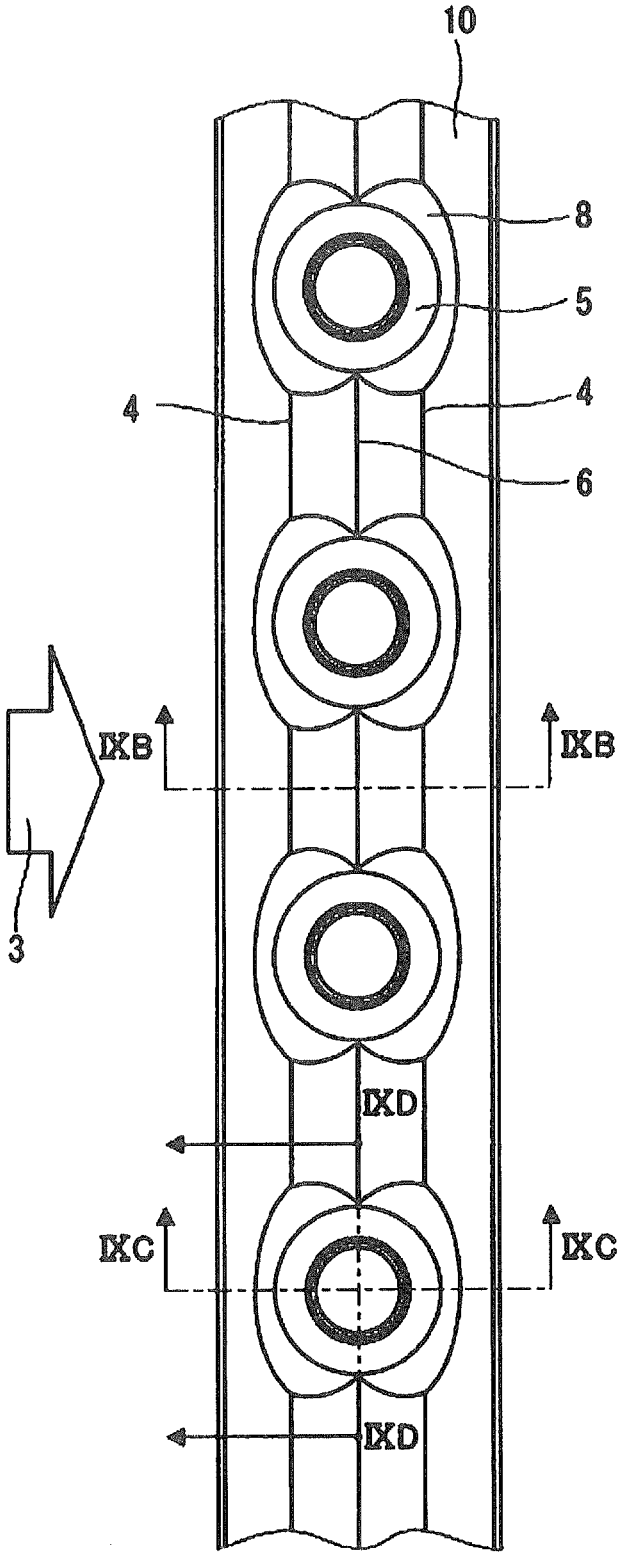
FIG. 9A is a plan view of a fin in a conventional fin tube heat exchanger.
Figure 9B:
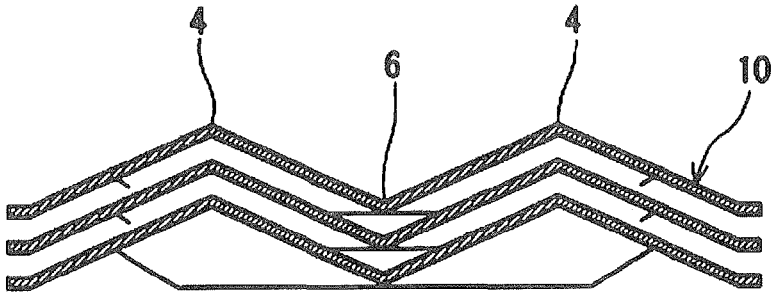
FIG. 9B is a sectional view of the fin illustrated in FIG. 9A, taken along line IXB-IXB.
Figure 9C:
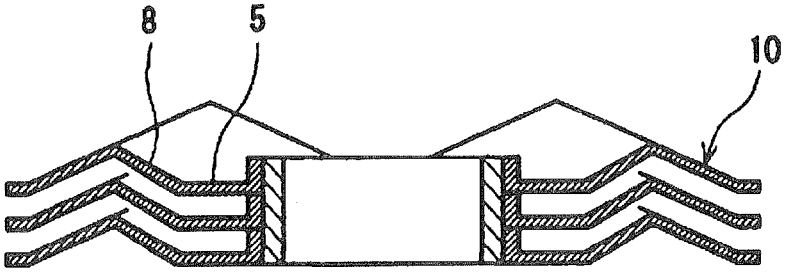
FIG. 9C is a sectional view of the fin illustrated in FIG. 9A, taken along line IXC-IXC.
Figure 9D:
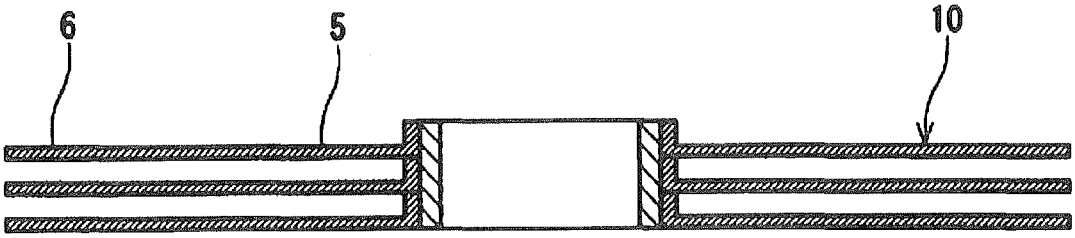
FIG. 9D is a sectional view of the fin illustrated in FIG. 9A, taken along line IXD-IXD.
Figure 10A:
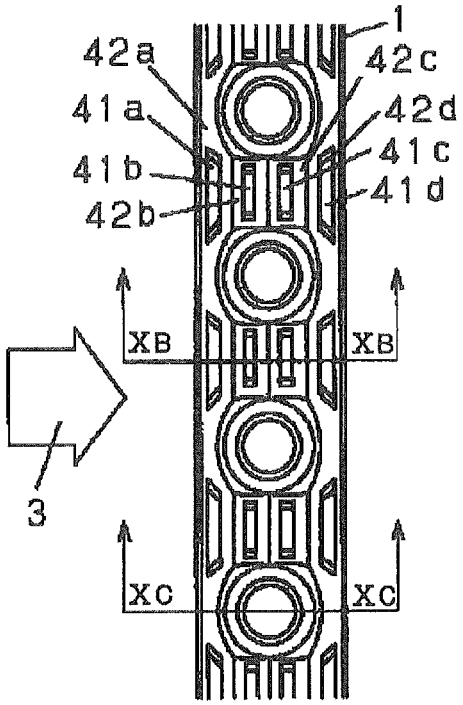
FIG. 10A is a plan view of another fin in the conventional fin tube heat exchanger.
Figure 10B:
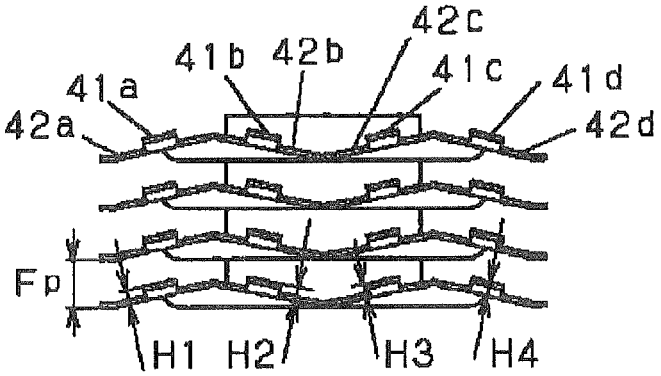
FIG. 10B is a sectional view of the fin illustrated in FIG. 10A, taken along line XB-XB.
Figure 10C:
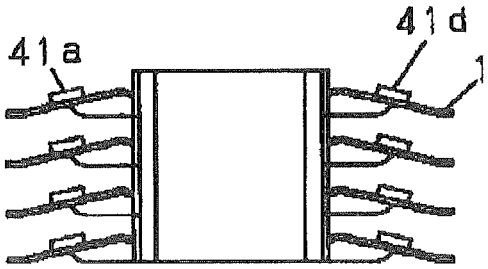
FIG. 10C is a sectional view of the fin illustrated in FIG. 10A, taken along line XC-XC.
Figure 11A:
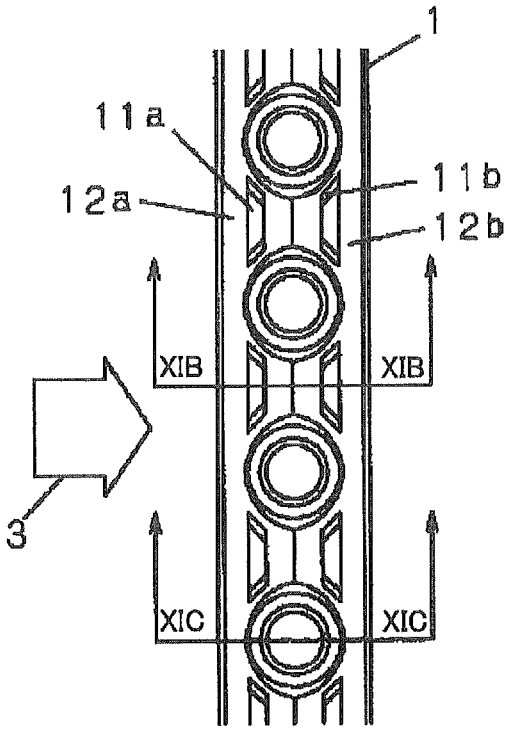
FIG. 11A is a plan view of yet another fin in the conventional fin tube heat exchanger.
Figure 11B:
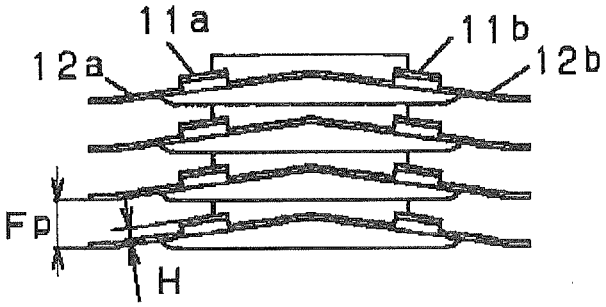
FIG. 11B is a sectional view of the fin illustrated in FIG. 11A, taken along line XIB-XIB.
Figure 11C:
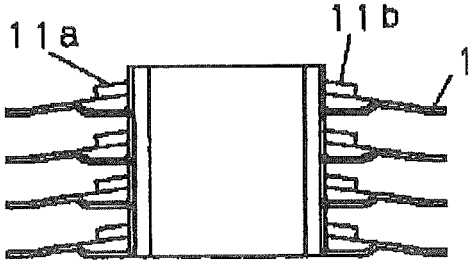
FIG. 11C is a sectional view of the fin illustrated in FIG. 11A, taken along line XIC-XIC.

FIG. 8B is a diagram illustrating yet another example of the shape of fin 31. Ridge line portion 39 of this fin 31 is linear on the upstream side and on the downstream side in the flow direction of air A, similarly to ridge line portion 39 of fin 31 illustrated in FIG. 8A. However, both the lateral sides of ridge line portion 39 are curved.

As described using FIG. 5A, even in the cases as illustrated in FIGS. 8A and 8B, angle θ2 formed between reference plane H1 and second inclined portion 38 in an area on the upstream side in the air stream direction is made to be within the range of the above-mentioned expression (6) or (7), when seen from the through hole into which heat transfer tube 21 is fitted. Thus, gap portion 40 is formed between ridge line portion 39 of one fin 31 and reference plane H1 of another fin 31 adjacent to the apex side of peak portion 34 of one fin 31.

As a result, air A easily flows through gap portion 40 near heat transfer tube 21 through which medium B flows, similarly to fin 31 illustrated in FIG. 3B. Further, it becomes possible to promote heat exchange at a location of fin 31 where the temperature difference relative to air A is the largest.

Further, the fin tube heat exchanger as described above can be applied to a refrigeration cycle apparatus. The refrigeration cycle apparatus is an apparatus in which a refrigeration cycle is configured such that a refrigerant circulates through a compressor, a condenser, a diaphragm apparatus and an evaporator.

By applying a fin tube heat exchanger as described above to at least one of the condenser and the evaporator of the refrigeration cycle apparatus, it becomes possible to enhance the coefficient of performance of the refrigeration cycle apparatus.

This application is entitled to and claims the benefit of Japanese Patent Application No. 2013-083462, filed on Apr. 12, 2013, the disclosure of which including the specification, drawings and abstract is incorporated herein by reference in its entirety.

INDUSTRIAL APPLICABILITY

The fin tube heat exchanger and the refrigeration cycle apparatus according to the embodiment of the present invention are suitable for use in a heat pump apparatus of a room air conditioner, a water heater, a heater or the like, for example.

REFERENCE SIGNS LIST

1 Fin
3 Air stream
4 Peak portion
5 Flat portion
6 Trough portion
8 Second inclined portion
10 Fin
11*a*, 11*b* Cut-and-raised portion
12*a*, 12*b* Fin inclined surface
21 Heat transfer tube
30*a* Front edge
30*b* Rear edge
31 Fin
34 Peak portion
35 Flat portion
36 First inclined portion
37 Fin collar
37*h* Through hole
38 Second inclined portion
38*a* Downstream side second inclined portion

39 Ridge line portion
39*a* Downstream side ridge line portion
40 Gap portion
41*a*, 41*b*, 41*c*, 41*d* Cut-and-raised portion
42*a*, 42*b*, 42*c*, 42*d* Fin inclined surface
100 Fin tube heat exchanger

The invention claimed is:

1. A fin tube heat exchanger comprising:

a plurality of fins arranged in parallel for forming a gas passage; and a heat transfer tube penetrating the plurality of fins, the heat transfer tube being configured to allow a medium that exchanges heat with the gas to flow through the heat transfer tube, wherein each of the fins is a corrugated fin shaped such that a peak portion appears only at one location in an air stream direction, the fins each comprising: a plurality of through holes into which the heat transfer tube is fitted; a flat portion formed around the through hole; a first inclined portion being inclined relative to the air stream direction so as to form the peak portion; and a second inclined portion connecting the flat portion and the first inclined portion, the plurality of through holes are formed along a step direction perpendicular to both a direction in which the plurality of fins are arranged and the air stream direction, and when a distance from an upstream end to a downstream end of the first inclined portion in the air stream direction is defined as S1, a distance from an upstream end to a downstream end of the flat portion in the air stream direction is defined as D1, a plane contacting the upstream end and the downstream end of the first inclined portion in the air stream direction from a side opposite to an apex side of the peak portion is defined as a reference plane, an angle formed between the reference plane and the first inclined portion is defined as θ1, an angle formed between the reference plane and the second inclined portion in an area on an upstream side in the air stream direction as viewed from the through hole is defined as θ2, a distance from the reference plane to the flat portion is defined as α, and a distance between the reference plane of one of the fins and the reference plane of another of the fins adjacent to the apex side of the peak portion is defined as L, in a case where the flat portion is on a side same as the apex side of the peak portion with respect to the reference plane, or in a case of α=0, the following relationship holds true:

$$\theta^\circ<\theta 2<\tan^{-1}[(L-\alpha)/\{(S1-D1)/2-L/\tan\theta 1\}],\text{ and}$$

in a case where the flat portion is on a side opposite to the apex side of the peak portion with respect to the reference plane, the following relationship holds true:

$$\theta^\circ<\theta 2<\tan^{-1}[(L-\alpha)/\{(S1-D1)/2-L/\tan\theta 1\}],\text{ and}$$

when an angle formed between the reference plane and the second inclined portion in the step direction is defined as θ2, and a center-to-center distance between portions of the heat transfer tube in the step direction is defined as S2, the angle θ2 further satisfies the following relationship:

$$\tan^{-1}\{2\cdot L/(S2-D1)\}<\theta 2<90^\circ,$$

in a case where the flat portion is on a side same as the apex side of the peak portion with respect to the reference plane, or in a case of α=0, the angle θ1 satisfies the following relationship:

$$\tan^{-1}(2\cdot(L-\alpha)/S1)<\theta 1<90^\circ,\text{ and}$$

in a case where the flat portion is on a side opposite to the apex side of the peak portion with respect to the reference plane, the angle θ1 satisfies the following relationship:

$$\tan^{-1}(2\cdot(L+\alpha)/S1)<\theta 1<90^\circ.$$

2. The fin tube heat exchanger according to claim 1, wherein each of the fins is configured to inhibit a flow of the gas from a front side to a rear side of the fin in an area of the fin other than the plurality of through holes.

3. A refrigeration cycle apparatus in which a refrigeration cycle is configured such that a refrigerant circulates through a compressor, a condenser, a diaphragm apparatus and an evaporator, wherein at least one of the condenser and the evaporator includes the fin tube heat exchanger according to claim 1.

* * * * *